US008303056B2

(12) United States Patent
Giorgi

(10) Patent No.: US 8,303,056 B2
(45) Date of Patent: Nov. 6, 2012

(54) CABINET OR SIMILAR ARTICLE OF FURNITURE WITH A SLIDING FOLDAWAY DOOR

(75) Inventor: Luca Giorgi, Agrate Brianza (IT)

(73) Assignee: Dada S.p.A., Mesero, Milan (IT)

( * ) Notice: Subject to any disclaimer, the term of this patent is extended or adjusted under 35 U.S.C. 154(b) by 477 days.

(21) Appl. No.: 12/306,297

(22) PCT Filed: Jun. 19, 2007

(86) PCT No.: PCT/IT2007/000435

§ 371 (c)(1),
(2), (4) Date: Dec. 16, 2009

(87) PCT Pub. No.: WO2007/148366

PCT Pub. Date: Dec. 27, 2007

(65) Prior Publication Data

US 2010/0117500 A1 May 13, 2010

(30) Foreign Application Priority Data

Jun. 23, 2006 (IT) ..... MI2006A1214

(51) Int. Cl.

| | |
|---|---|
| ***A47B 88/00*** | (2006.01) |
| ***A47B 49/00*** | (2006.01) |
| ***E05D 15/00*** | (2006.01) |
| ***E05D 15/26*** | (2006.01) |

(52) U.S. Cl. ..... 312/322; 160/201; 160/203; 160/208; 160/214; 312/326

(58) Field of Classification Search ..... 312/322, 312/319.2, 326, 329, 350; 49/125, 127–130, 49/213, 360; 160/196.1, 199, 201, 203, 206, 160/208, 214

See application file for complete search history.

(56) References Cited

U.S. PATENT DOCUMENTS

| | | | | |
|---|---|---|---|---|
| 756,091 | A * | 3/1904 | Altick | 52/71 |
| 1,873,522 | A * | 8/1932 | Abbott et al. | 109/70 |
| 3,736,805 | A * | 6/1973 | Dent | 474/250 |
| 4,350,399 | A * | 9/1982 | Berton et al. | 312/297 |
| 4,945,972 | A * | 8/1990 | Takeuchi | 160/203 |
| 5,131,449 | A * | 7/1992 | Winn et al. | 160/199 |
| 5,685,355 | A * | 11/1997 | Cook et al. | 160/202 |
| 6,449,905 | B2 * | 9/2002 | Maki | 49/360 |
| 6,658,793 | B2 * | 12/2003 | Perron | 49/123 |
| 2001/0027621 | A1 * | 10/2001 | Davies et al. | 49/360 |

(Continued)

FOREIGN PATENT DOCUMENTS

DE 3934600 A1 * 5/1991

(Continued)

*Primary Examiner* — Darnell Jayne
*Assistant Examiner* — Andrew Roersma
(74) *Attorney, Agent, or Firm* — Shoemaker and Mattare

(57) ABSTRACT

A cabinet door collapses and slides into a concealed position inside a door compartment of a cabinet. The door has a first wing which is pivotally connected to a second wing and to a vertical door-supporting bar which travel insides the door compartment. The second wing is guided by carriages running in upper and lower continuous guideways that extend inside the door compartment. A device for moving the door-supporting bar includes a stationary toothed belt inside the door compartment, a toothed wheel and guide pulleys carried by the door-supporting bar. The toothed wheel is operatively connected to a torsion spring inside the door-supporting bar. A locking device locks the toothed wheel, when the door wings are in a coplanar closed position, and releases the toothed wheel, when they are in a parallel open position.

7 Claims, 8 Drawing Sheets

U.S. PATENT DOCUMENTS

| | | | | |
|---|---|---|---|---|
| 2002/0042317 | A1 * | 4/2002 | South | 474/264 |
| 2006/0255699 | A1 * | 11/2006 | Punzel et al. | 312/217 |
| 2007/0272372 | A1 * | 11/2007 | Glover | 160/206 |

FOREIGN PATENT DOCUMENTS

| | | | |
|---|---|---|---|
| DE | 4308196 | A1 * | 10/1993 |
| FR | 2366430 | | 4/1978 |
| FR | 2690195 | | 10/1993 |
| GB | 2227280 | A * | 7/1990 |
| IT | 1259209 | | 3/1996 |
| JP | 54039936 | A * | 3/1979 |
| WO | WO 8907185 | A1 * | 8/1989 |

* cited by examiner

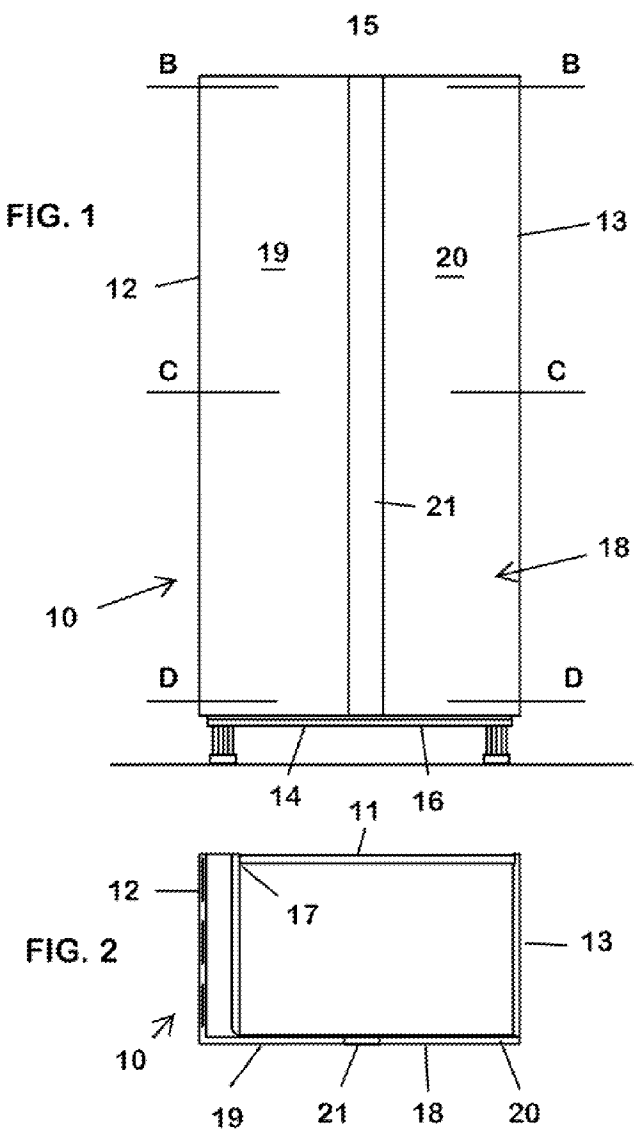
FIG. 1
FIG. 2
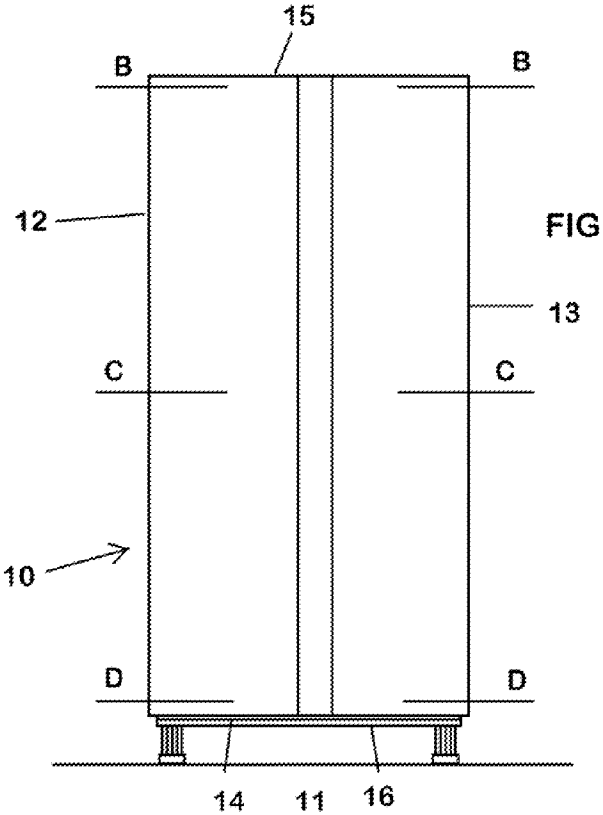
FIG. 3
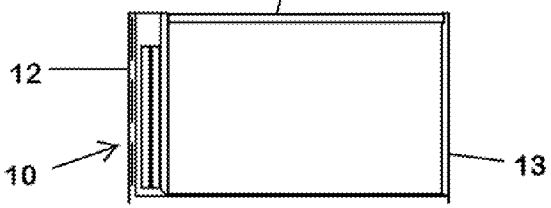
FIG. 4

CABINET OR SIMILAR ARTICLE OF FURNITURE WITH A SLIDING FOLDAWAY DOOR

TECHNICAL FIELD

The present invention is related to a cabinet, or a similar article of furniture, of the kind having a door or shutter which is collapsible and slidable into a concealed position.

BACKGROUND ART

Cabinets of the aforesaid kind are known in the art in different structural forms, for example from FR 2 366 430. A rather conventional structural form is disclosed, for instance, in Italian patent No. 1259209, application No. PN92A000024 of Feb. 4, 1992 (corresponding to the publication FR 2 690 195). According to the structural form of this patent, the cabinet is formed of a body having a parallelepiped shape and comprising at least two door wings connected one to the other and arranged to slide in guideways located along a front edge of top and bottom walls of the cabinet body, and along top and bottom walls of a door compartment defined by a side wall of the cabinet body and a vertical partitioning wall inside thereof.

The door wings are foldable from a coplanar closing position to a parallel opening position, and then they are slidable in a concealed position into the door compartment.

One of the door wings, so called "drive wing", exhibits a vertical side which is connected via hinges to a slide means which is movable along guideways extending in the door compartment along the bottom and top walls of the cabinet body, from a front edge to a rear wall thereof. The other door wing, so called "driven wing", exhibits a vertical side which is connected via hinges to a slide means which is movable along guideways extending lengthwise the front edges of the top and bottom walls of the cabinet body. The door wings are connected via spring hinges to an intermediate panel provided with an operating handle.

The guideways extending along the bottom and top walls of the door compartment comprise two opposite racks and the slide means of the drive wing include two toothed wheels which mesh with one another on one internal side and are each engaged with one of the racks on the other external side.

In a first phase of movement, the door wings are brought from the closing position, in which they are substantially coplanar, to the opening position, in which the two door wings match one another side by side. In the opening position the slide means of the drive wing are in an extracted position and the slide means of the driven wing are located in suitable receiving housings provided inside the slide means of the drive wing. In these housings, the slide means of the driven wing release spring operated check means providing to hold the slide means of the drive wing in the extracted condition.

In a second phase of movement, the door wings are brought to a concealed position in which both door wings are lead into the door compartment and the intermediate panel contacts the front edge of the cabinet body and closes the door compartment.

Whilst the aforesaid structural form represents one of the most widespread solutions amongst those available in the art, however it exhibits some drawbacks which cause it to be noisy, faulty and poorly reliable in operation.

A first drawback is given by the fact that the movement of the door wings occurs in a discontinuous manner, because it is interrupted between the first and second phase of movement, i.e. at the moment the two door wings are in the folded opening position and they match one another side by side. The interruption is necessary to permit the slide means of the driven wing to move into its receiving housing inside the slide means of the drive wing. In time, however, this operation becomes faulty, mainly because the mechanical parts intended to be mated wear out and because dirt collects on the mechanical parts. Thus, a jamming of the door wing movement mechanism may occur, and therefore maintenance work becomes necessary.

A second drawback of the structural form known in the art is given by the fact that the movement of the door wings into and out of the door compartment is rather noisy, and this is mainly due to the presence of the guide racks extending along the bottom and top walls of the door compartment, as well as to the toothed wheels of the slide means of the drive wing which mesh therewith. Furthermore, it may occur that the toothed wheels, so as to say, "jump" a tooth of a rack; thereby causing the door wings to become misaligned with the door compartment and to be difficult to move.

A third drawback of the known structural form is given by the fact that in order to move the door wings into and out of the concealed position inside the door compartment, the user has to manually operate the operating handle to push and pull the wings, respectively. In fact, according to a known variant of the structural form described above there is provided a linked frame consisting of a pair of crossing arms which are joined pivotally together and to the vertical hinged side of the driving wing and are arranged to slide into the door compartment. The linked frame is provided with an extension spring which retains the arms in a retracted position. Because this spring is loaded when the door wings are pulled out of the door compartment, it is capable of producing a recovery force which is sufficient to cause the door wings to move into the concealed position inside the door compartment, without requiring manual operation by the user.

However, also the operation of this variant is noisy, particularly because of the presence of the linked frame, and the linked frame itself is rather large in size, and therefore, external dimensions of the cabinet being equal, the door wings cannot be entirely moved into the door compartment, but they extend from the front edges of the top and bottom walls of the cabinet body.

DISCLOSURE OF THE INVENTION

The invention is aimed at overcoming these and other drawbacks of the known art. In particular, according to the invention, this task is solved by the provision of a cabinet, or a similar article of furniture, of the kind with a sliding foldaway door according to the features of claim 1.

BRIEF DESCRIPTION OF DRAWINGS

The present invention will now be described in connection with the accompanying drawings, wherein:

FIG. 1 is a front elevation view of the cabinet according to the present invention, illustrated with the door wings in a coplanar closing position, FIG. 2 is a plan view of the cabinet of FIG. 1 shown without the top wall, FIG. 3 is a front elevation view of the cabinet according to the present invention, illustrated with the door wings in a parallel opening position and moved into a concealed position inside a door compartment of the cabinet, FIG. 4 is a plan view of the cabinet of FIG. 3 shown without the top wall.

BEST MODE OF CARRYING OUT THE INVENTION

Figure 5:
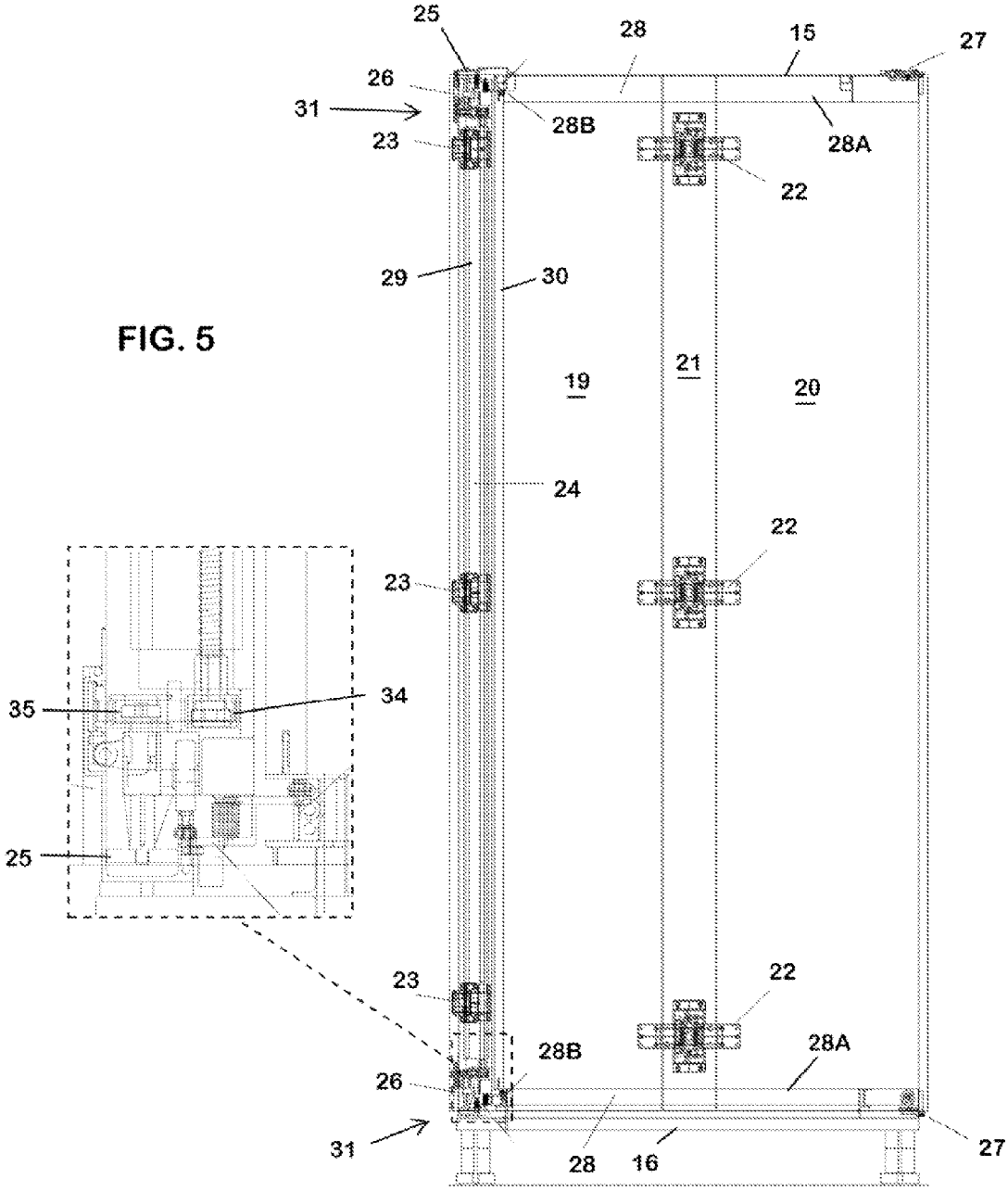
FIG. 5 is a phantom view of the cabinet of FIG. 1.

In the Figures of the drawings there is diagrammatically depicted an exemplifying embodiment of a cabinet according to the present invention, generally designated by 10. In the illustrated embodiment, the cabinet of the invention is provided with only one door. However, from the following disclosure, and the appending claims, a person skilled in the art will recognise that the scope of the invention is not limited to a cabinet having only one door, but it comprises also cabinets having a pair of doors arranged in mirror symmetry, one in the right zone and the other in the left zone, respectively, of the cabinet. However, for the sake of simplicity, but without loss of generality, reference will be made in the following to a cabinet having only one door as depicted in the drawings.

Referring to FIGS. 1-5 of the drawings, there is shown the cabinet 10 of the invention which is formed of a body of parallelepiped shape, the cabinet body being open to the front and having a rear wall 11, first and second side walls 12 and 13, a bottom wall 14 and a top wall 15. The cabinet body, moreover, includes a bottom frame 16, to which the bottom wall 14 is fixed, and a top frame 17, to which the top wall 15 of the cabinet is fixed. The bottom frame 16 is suitably mounted on supporting feet.

The cabinet 10 is provided with a collapsible door 18, which is intended to close the opening on the front side. This door is formed of a first wing 19 and a second wing 20, which are pivotally connected to an intermediate panel 21 via hinges 22.

Door wing 19 operates as a drive wing and is pivotally connected via hinges 23 to a vertical door-supporting bar 24. The door supporting bar 24 is provided with lower and upper guide rollers 25 and is guided to travel in a horizontal direction and on a parallel direction to the side wall 12 of the cabinet, on suitable guideways 26 arranged at lower and upper portions of the side wall 12.

Door wing 20, instead, operates as a driven wing and is provided with lower and upper guide carriages 27 which are mounted to rotate on pivots and are arranged to travel along suitable guideways 28 which are fixed to the lower frame 16 and the upper frame 17, respectively, of the cabinet 10. The guideways 28 extend, without interruption, in a lower horizontal plane and in an upper horizontal plane, respectively, and they exhibit a first guideway section 28A, which is parallel to the front open side, and a second guideway section 28B, which is parallel to the side wall 12 of the cabinet. The first guideway section 28A is suitably connected to the second guideway section 28B by means of a curvilinear guideway connecting section.

With the door structure as described, the door wings 19 and 20 are collapsible from a coplanar closing position to a parallel opening position and, further, they can slide into a concealed position inside a door compartment 29 which is defined by the side wall 12 and an internal partitioning wall 30 of the cabinet.

For the opening and closing operation of the cabinet door 18 there is provided an operating handle (not illustrated) which is secured to the intermediate panel 21. Suitably, hinges 22 are built as spring hinges in order to permit the door wings 19 and 20 to self-return from the parallel opening position to the coplanar closing position when the cabinet door 18 is manoeuvred to be closed.

Figure 6:
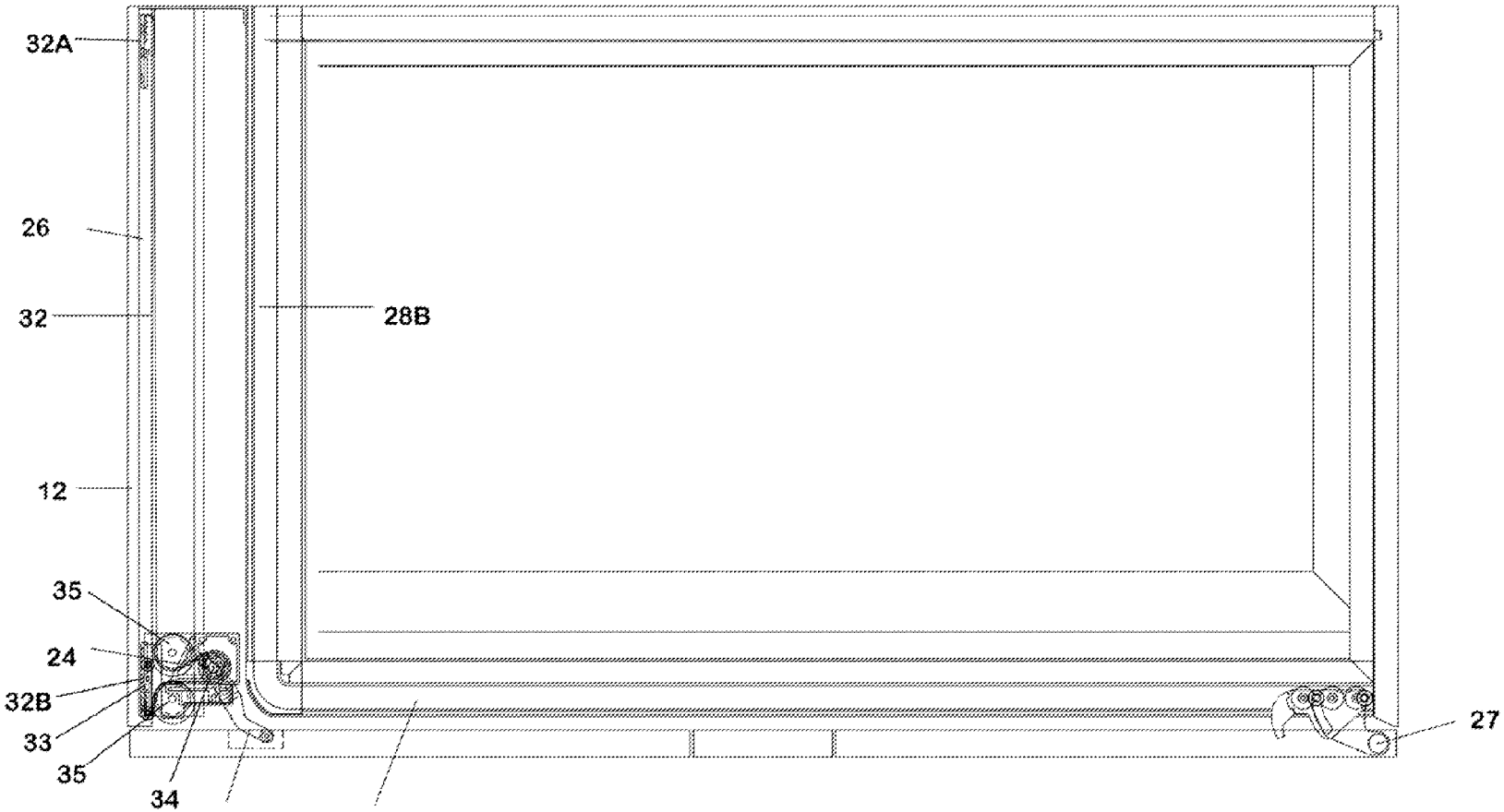
FIG. 6 is a section view of the cabinet taken along line B-B of FIG. 1.
Figure 7:
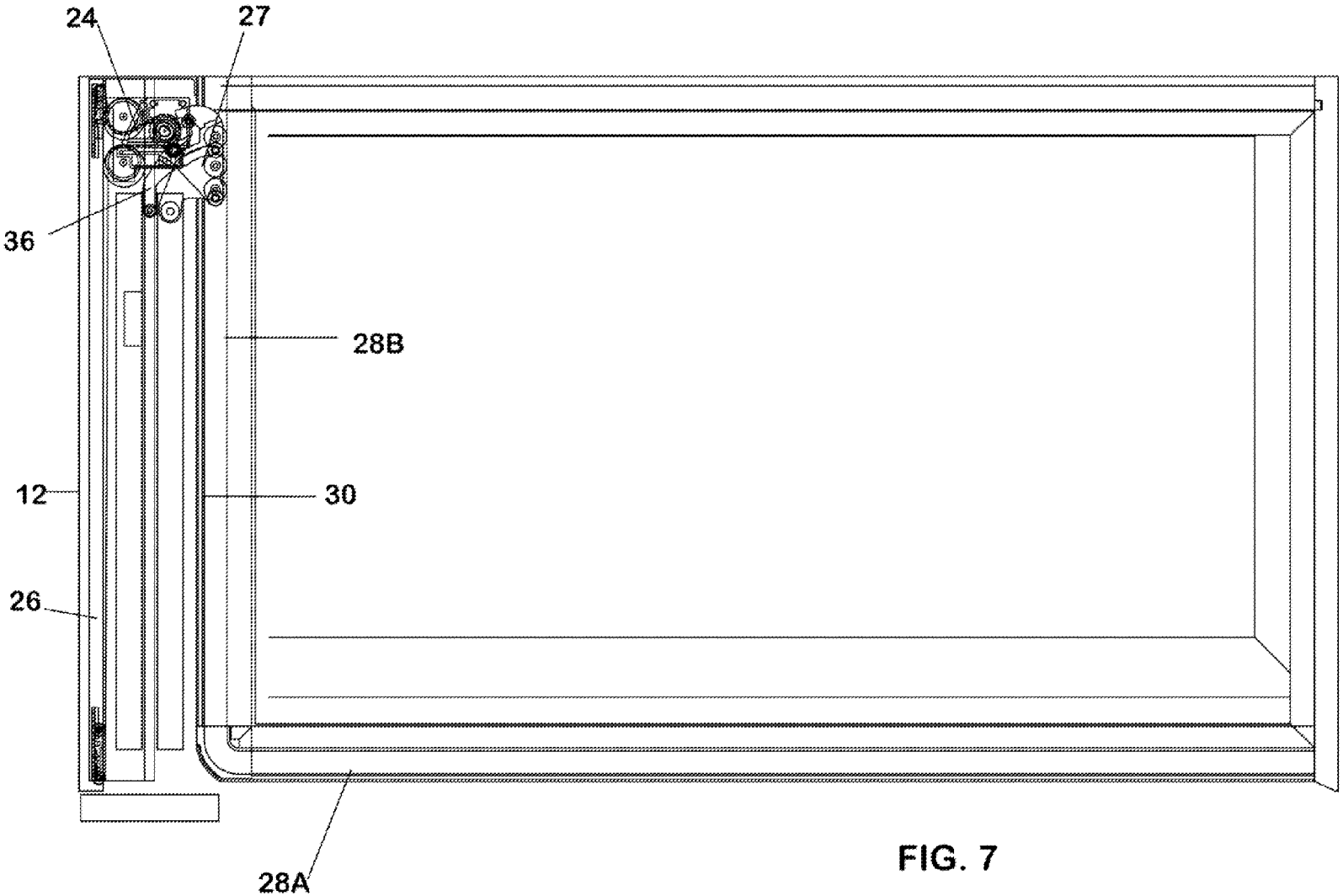
FIG. 7 is a section view of the cabinet taken along line B-B of FIG. 3.
Figure 8:
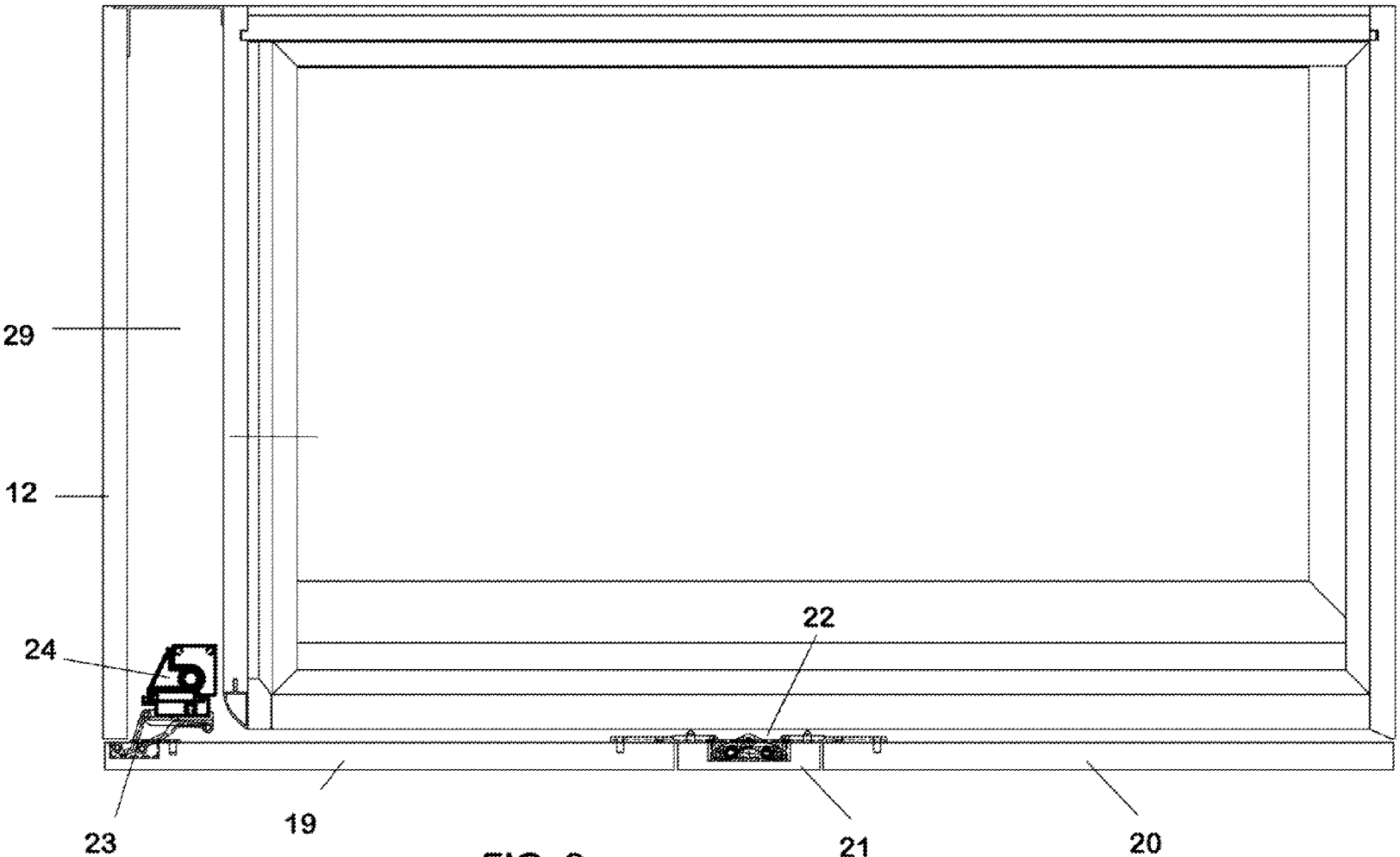
FIG. 8 is a section view of the cabinet taken along line C-C of FIG. 1.
Figure 9:
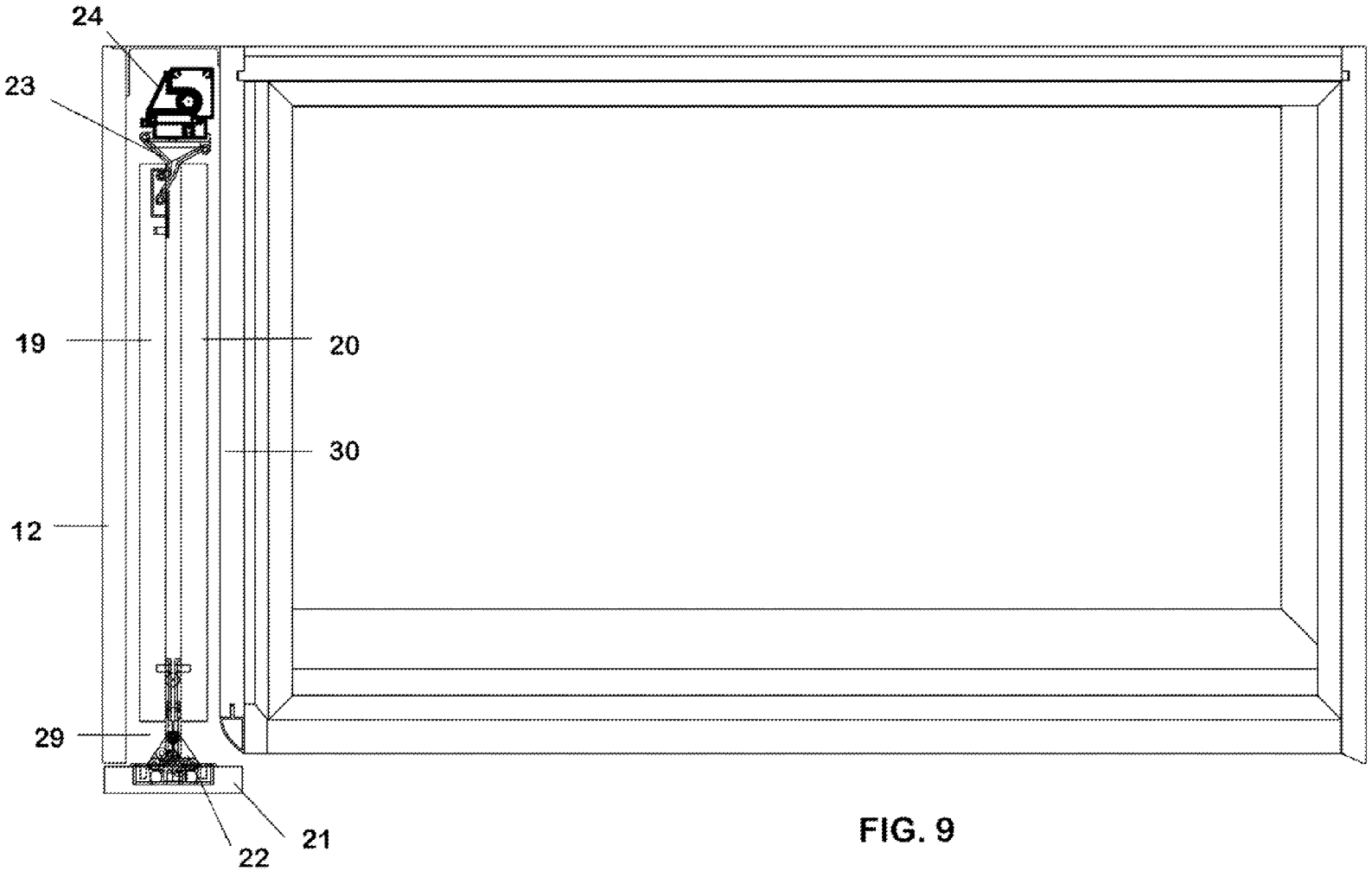
FIG. 9 is a section view of the cabinet taken along line C-C of FIG. 3.
Figure 10:
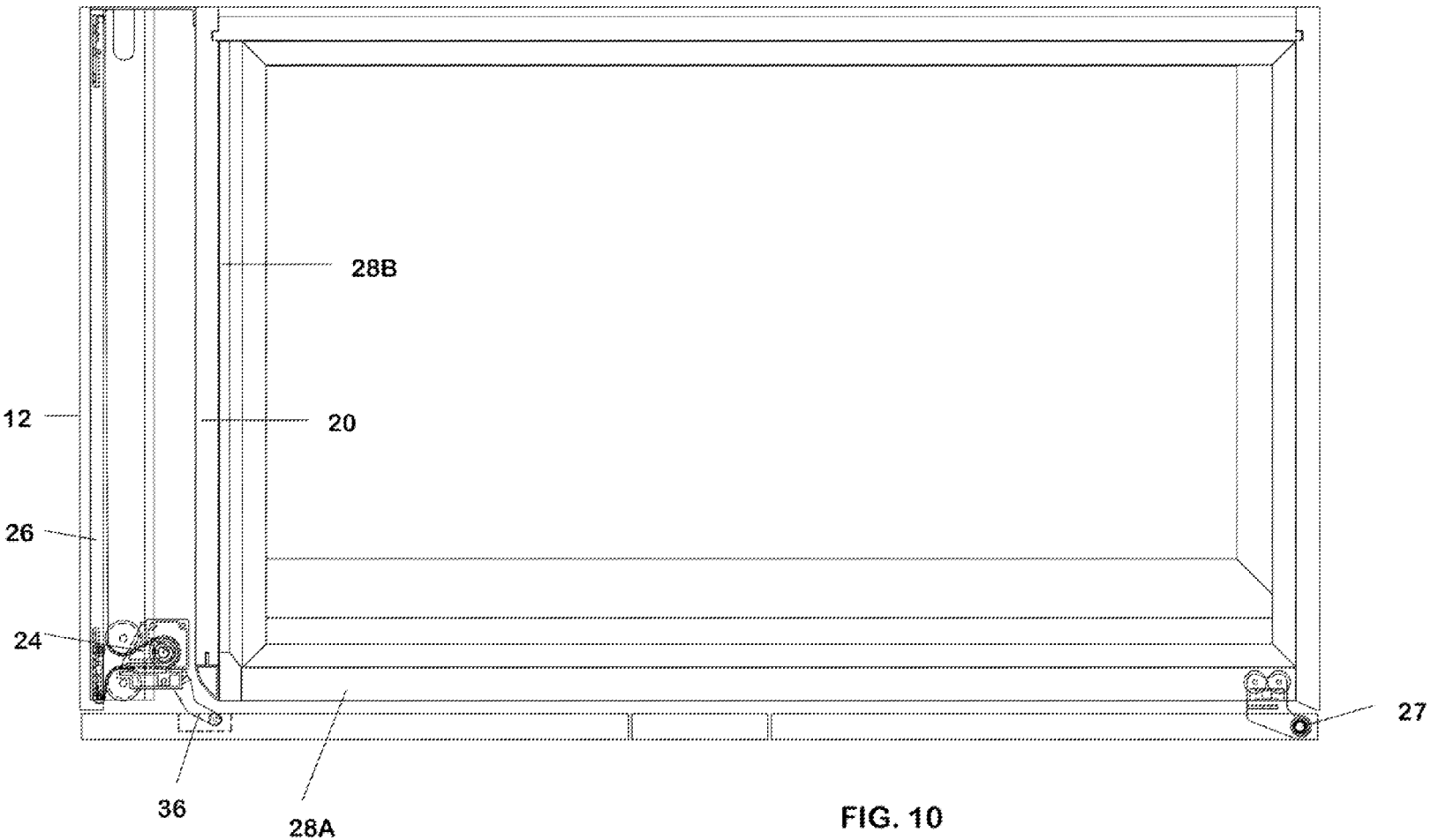
FIG. 10 is a section view of the cabinet taken along line D-D of FIG. 1.
Figure 11:
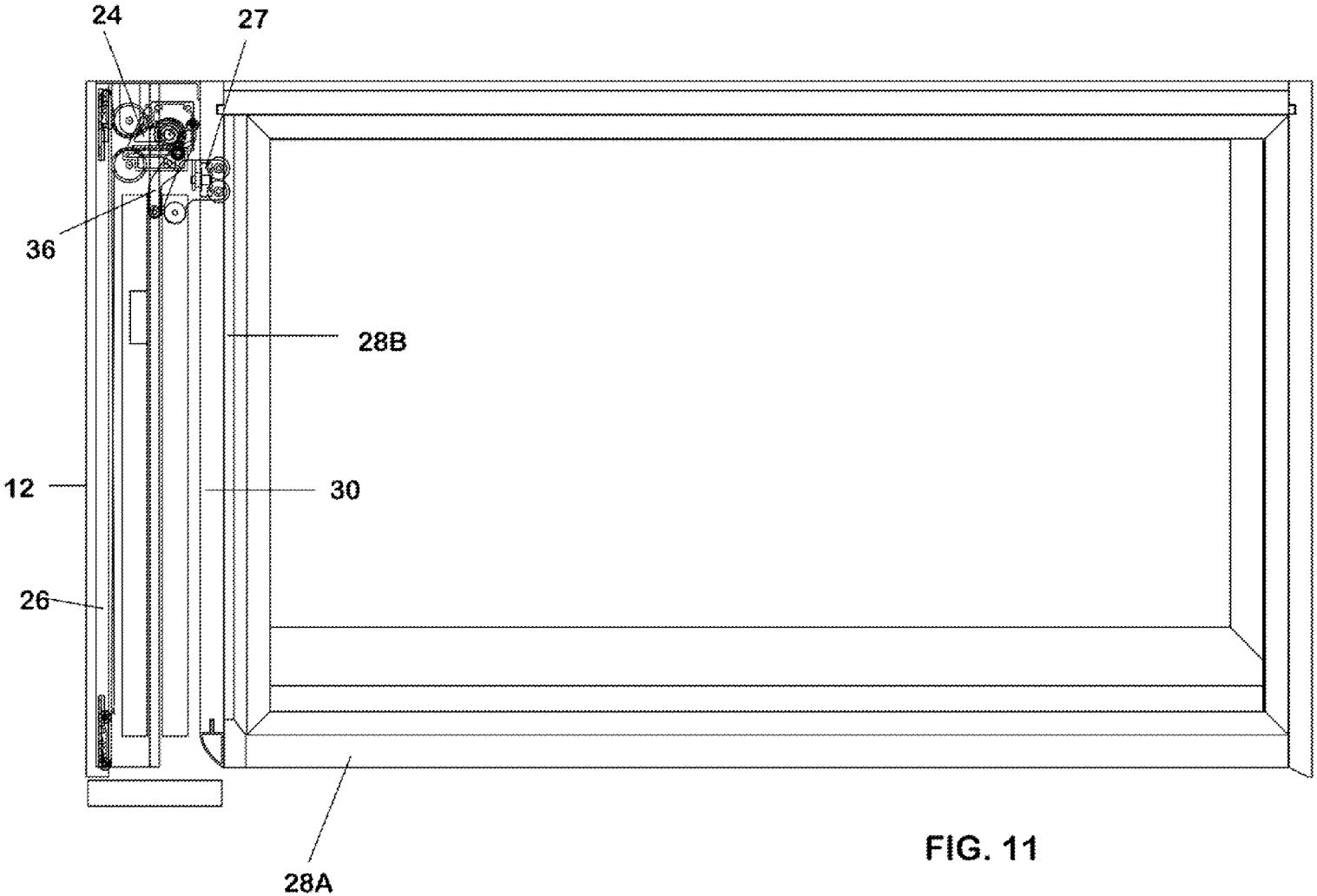
FIG. 11 is a section view of the cabinet taken along line D-D of FIG. 3.

According to present invention, for the movement of the door-supporting bar 24 inside the door compartment 29 a toothed drive belt device is provided which is designated generally by 31 and is arranged both at the lower and upper end portions of the door-supporting bar 24. This toothed drive belt device is illustrated more clearly in FIGS. 6-11 of the drawings.

The toothed drive belt device 31 comprises a toothed belt 32 which is arranged stationary inside the door compartment and is parallel to the direction of movement of the door-supporting bar 24. An end portion 32A of the toothed belt is directly attached to the side wall 12 of the cabinet 10, whereas the other end portion 32B is connected indirectly to the aforesaid side wall 12 by means of a belt tightening device 33, thus permitting the belt tension to be adjusted. The toothed belt 32 is provided with a steel wire insert which greatly reduces the elastic elongation thereof, so that movement inaccuracies of the door-supporting bar 24 can be avoided.

In its upper and lower end portions the vertical door-supporting bar 24 carries a toothed wheel 34 and two guide pulleys 35 arranged at sides of the toothed wheel 34, whereby the toothed belt 32 of the toothed drive belt device 31 is guided with the formation an open loop around the toothed wheel 34.

Each toothed wheel 34, together with its shaft, is pivotally carried by a corresponding end portion of the door-supporting bar 24 and the shaft thereof is operatively connected to a torsion spring arranged inside the door-supporting bar 24. The guide pulleys 35 are arranged to rotate about the same pivot of the guide rollers 25 of the door-supporting bar 24.

The door-supporting bar 24, furthermore, is provided with a locking device 36 which is arranged to lock the toothed wheels 34, when the two door wings 19 and 20 are in the coplanar closing position illustrated in FIGS. 1 and 2 of the drawings. The locking device 36 is suitably released when the two door wings 19 and 20 are in the fully collapsed opening position, thereby to disengage the corresponding toothed wheel 34 and, thus, permit a reverse movement of the door wings to disappear inside the door compartment 29, as illustrated in FIGS. 3 and 4 of the drawings.

The operation of the toothed drive belt device 31 is the following. In the manoeuvre to close the cabinet 10 of the invention, when the door wings 19 and 20 of the cabinet door 18 are pulled out of the door compartment 29, the toothed drive belt devices 31 each cause a synchronous counter-clockwise rotation of the corresponding toothed wheel 34. As a result of this rotation, the springs inside the door-supporting bar 24 are subject to a torsion stress and they store elastic energy by deformation. In the manoeuvre to open the cabinet, when the door wings 19 and 20 are outside of the door compartment 29, in the fully collapsed opening position, and the locking devices 36 are released, the springs are free to return the elastic energy stored in the manoeuvre to close the cabinet and thus they cause a synchronous clockwise rotation of the toothed wheels 34. The synchronous rotation of the toothed wheels 34 is converted, via the toothed belts 32 of the toothed drive belt devices 31, into a translation movement of the door-supporting bar 24, whereby the door wings 19 and 20 move into a concealed position inside the door compartment 29.

From tests carried out on a cabinet provided with a toothed drive belt device 31 as described above, it was found that all the drawbacks of the prior art were overcome. In particular, the toothed drive belt device 31 is comparatively less noisy and achieves a more accurate and jamming-free movement. Moreover, since the guideways 28 of the driven wing 20 extend without interruptions the movement of the door 18 is smoother and free from interruptions.

The invention claimed is:

1. In an article of furniture comprising a door compartment and a door which is collapsible and slidable into a concealed position inside the door compartment, said door comprising a first door wing, a second door wing pivotally connected to said first door wing, the first door wing being pivotally connected to a vertical door-supporting bar having guide rollers at a lower and upper end thereof and being arranged to travel inside the door compartment on lower and upper guideways extending therein, wherein the second door wing has guide carriages located on an upper and lower edge thereof which are arranged to travel in upper and lower continuous guideways extending parallel to a front edge of the article of furniture and inside the door compartment, the improvement comprising a toothed drive belt device for moving the door supporting bar inside the door compartment, said toothed drive belt device comprising a toothed belt arranged stationary inside the door compartment parallel to the direction of movement of the door-supporting bar, said toothed belt co-operating with a toothed wheel and guide pulleys carried by the door-supporting bar, at the upper and lower ends thereof, and a rotatable shaft upon which the toothed wheel is mounted, wherein the toothed wheel, together with a shaft thereof, is pivotally carried by a corresponding end portion of the door-supporting bar and the toothed belt is guided by the guide pulleys in an open loop around the toothed wheel, the door-supporting bar having a locking device which is arranged to lock the toothed wheel, when the door wings are in a coplanar closing position, and to release the toothed wheel, when the door wings are in a parallel opening position, wherein the guide pulleys and the guide rollers of the door-supporting bar are arranged to rotate about a common pivot.

2. An article of furniture according to claim 1, wherein the door-supporting bar carries in upper and lower end portions thereof a toothed wheel and two guide pulleys arranged at sides of said toothed wheel.

3. An article of furniture according to claim 1, wherein the upper and lower guideways of the second door wing consist each of a first guideway section extending along the front edge of the article of furniture and a second guideway section extending inside the door compartment, said first guideway section being connected in a continuous manner to said second guideway section by means of a curvilinear guideway connecting section.

4. An article of furniture according to claim 1, wherein the guide carriages are pivotally connected to the upper and lower edge of the second door wing.

5. An article of furniture according to claim 1, wherein said shaft is operatively connected to a torsion spring arranged inside the door-supporting bar.

6. An article of furniture according to claim 1, further comprising a belt tightening device for adjusting the tension of the toothed belt.

7. An article of furniture according to claim 1, wherein the toothed belt is reinforced to reduce the elastic elongation thereof.

* * * * *